United States Patent [19]

Takahashi

[11] Patent Number: 5,018,198

[45] Date of Patent: May 21, 1991

[54] SPEECH PRIVACY PROCESSING METHOD AND APPARATUS THEREFOR

[75] Inventor: Futoshi Takahashi, Tokyo, Japan

[73] Assignee: Canon Kabushiki Kaisha, Tokyo, Japan

[21] Appl. No.: 466,953

[22] Filed: Jan. 18, 1990

[30] Foreign Application Priority Data

Jan. 20, 1989 [JP] Japan ..... 1-009819

[51] Int. Cl.[5] ..... H04K 1/06

[52] U.S. Cl. ..... 380/38; 380/39; 380/40

[58] Field of Search ..... 380/38, 39, 40; 370/120

[56] References Cited

U.S. PATENT DOCUMENTS 4,525,844 6/1985 Scheuermann ..... 380/38 X
4,623,980 11/1986 Vary ..... 380/38 X
4,827,507 5/1989 Marry et al. ..... 380/38

OTHER PUBLICATIONS

"Frequency Inversion Scrambler Uses Micro-Processed SSB Audio", W. V. Lanep et al., pp. 34–40; Mobil Radio Technology, Aug. 1984.

*Primary Examiner*—Thomas H. Tarcza
*Assistant Examiner*—Tod Ray Swann
*Attorney, Agent, or Firm*—Fitzpatrick, Cella, Harper & Scinto

[57] ABSTRACT

A speech privacy processing apparatus is disclosed including:

a unit for obtaining the number of coefficients commonly included in a set of coefficients obtained by Fourier transformation and corresponding to high-frequency spectrum components of an input original speech signal and the set of coefficients corresponding to the high-frequency spectrum components after scrambling processing;

scrambler for repetitively performing scrambling processing until the number of the common coefficients becomes smaller than a predetermined threshold value;

a counter for counting the number of repetitions of the scrambling processing and transmitting the count to a receiver side;

a unit for extracting a repetition count of scrambling processing from a reception signal;

descrambler for performing descrambling processing in accordance with the extracted repetition count; and a unit for reproducing a speech signal.

8 Claims, 5 Drawing Sheets

SPEECH PRIVACY PROCESSING METHOD AND APPARATUS THEREFOR

BACKGROUND OF THE INVENTION

1. Field of the Invention

The present invention relates to a speech privacy processing method used when an analog speech signal is transmitted on an analog line whose transmission path band is limited and, more particularly, to a speech privacy processing method by an FFT scrambler method utilizing fast Fourier transformation and an apparatus therefore.

2. Related Background Art

Along with a recent increase in communication traffic, secret communication techniques for preventing a communication content from being known to a third party have gained their importances. Of these techniques, a privacy processing technique is a technique for performing secret communication on a transmission path whose band is limited, e.g., a general public line. Originally, in privacy processing of a speech signal, when a speech signal is subjected to complicated privacy processing to enhance a degree of privacy, quality of a descrambled speech signal is degraded. On the contrary, when degradation of the quality is to be avoided, a sufficient privacy strength cannot be obtained. As a method of simultaneously attaining secrecy and protection of an analog speech signal and high quality of a descrambled speech signal, a coefficient substitution method (FFT scrambler method) using fast Fourier transformation (to be referred to as FFT hereinafter) is known.

The prior art will be described below with reference to the accompanying drawings.

FIGS. 2A and 2B are block diagrams of a privacy processing apparatus of an analog speech signal by a conventional FFT scrambler method. In FIG. 2A, an analog speech signal x(t}to be subjected to privacy processing is input from an input terminal 31 to an A/D converter 32 and is converted to discrete signals x(n) (n=0, 1, 2, . . . ). The sample values are framed in units of N points (=one frame) by a framing circuit 33 In this case, frame sync data 38*a* indicating the beginning of each frame is supplied to a sync signal generator 38, thereby generating a frame sync signal 38*b*.

FIG. 3A shows a time waveform of an original signal, and its frame. This frame is input to an N-point FFT processor 34 to obtain n FFT coefficients X(k) (k=0, 1, . . . , n−1) from N time waveform sample values x(n) (n=0, 1, . . . , n−1). A digital signal x(n) obtained as a result of sampling of an input speech signal is expressed by:

$$x(n)=\lambda A(\lambda)\cos(\alpha\cdot\lambda n)+\theta(\lambda))$$

A discrete Fourier coefficient X(k) obtained from the FFT processor 34 is given by:

$$X(k)=\sum_{n=0}^{N-1} x(n)e^{(2\pi nk/N)j}$$

(k=0, 1, . . . , n−1)

FIG. 3B(*a*) shows N FFT coefficients X(k) (k=0, 1, . . . , N−1) of one frame.

The N FFT coefficients are subjected to random substitution by a scrambler 35. FIG. 3B(*b*) partially shows this state. When N sample values Y(0), Y(1),..., Y(N−1) on the frequency axis obtained in this manner are input to an IFFT (Inverse Fast Fourier Transformation) processor 36, N sample values y(n) (n=0, 1, . . . , N) of a privacy signal to be calculated can be obtained. These sample values are converted to an analog privacy signal y(t) by a D/A converter 37, and the converted signal is transmitted onto a transmission path. FIG. 3C shows the privacy signal y(t). In this case, $$y(n)=\frac{1}{N}\sum_{k=0}^{N-1} Y(k)e^{-(2\pi nk/N)j}$$

(n=0, 1, . . . , N−1)

As can be seen from FIG. 3B, the privacy signal y(t) can be transmitted in the same frequency band as that of the original speech signal. When the signal y(t) is sent onto a transmission path, the frame sync signals 38*b* generated by the sync signal generator 38 and indicating a boundary of each frame are added to the signal y(t).

At a receiver side, a sync signal extractor 39 extracts the frame sync signals added at a transmitter side from the input privacy signal Thereafter, the privacy signal is converted into a digital signal by an A/D converter 40, and is divided into frames by a frame sync circuit 41 in accordance with the extracted frame sync signals. N sample values y(0), y(1) , . . . , y(N−1) of one frame are converted to sample values Y(k) (k=0, 1, . . . , N−1) in a frequency range by an FFT processor 42, and the converted sample values are then subjected to inverse transformation processing (descrambling) to the scrambling processing at the transmitter side by a descrambler 43, thus obtaining X(k) (k=0, 1, . . . , N−1). The output from the descrambler 35 is subjected to inverse discrete Fourier transformation by an N-point IFFT processor 44, and the transformed signal is then converted to an analog signal by a D/A converter 45. As a result, a descrambled original speech signal x(t) is output from an output terminal 46.

In the above method, as the number N of samples in one frame is larger, privacy processing performance is improved, and FFT coefficients obtained by the FFT processor are approximate to true frequency spectrum components. Therefore, quality of a descrambled speech signal is good. However, if the value N is increased, a processing delay time required in FFT and IFFT is increased. Therefore, the upper limit of the value N is determined according to an allowable maximum delay time.

Since FFT calculations can be most efficiently made by the butterfly algorithm when N is a power of 2, a maximum power of 2 which does not exceed the above-mentioned upper limit is adopted as the value N.

As described above, in a speech privacy processing apparatus using FFT, a privacy signal can be transmitted in the same band as an original signal, and quality of a descrambled speech signal is relatively good. However, since this apparatus adopts FFT, the following drawbacks are posed. More specifically, as a frequency becomes higher, the hearing resolution of a person is degraded accordingly. However, FFT analysis has the same resolution at any frequency. For this reason, even if FFT coefficients in a high frequency band are subjected to substitution processing such as a scrambler, such processing is redundant (wasteful) in terms of privacy processing. In some cases, a large number of invalid substitution patterns which cannot provide a sufficient privacy effect may be generated.

FIG. 4 shows this situation. FIG. 4 explains invalid substitution patterns generated by substitution processing by a scrambler with 10 samples/frame. 10 coefficients X(1), X(2), . . . , X(10) obtained by FFT of an input original signal are rearranged by the scrambler on a frequency axis to be converted to Y(1), Y(2), . . . , Y(10). In this case, FFT coefficients X(7), X(8), X(9), and X(10) are present in a high-frequency range in which the sense of hearing of a person is degraded. Upon substitution by the scrambler, Y(7), Y(8), Y(9), and Y(10) are obtained by randomly reordering X(7) to X(10). A frequency component of a privacy signal in a low-frequency range is Y(k)=X(k) (k=1, 2, . . . , 6), i.e., is the same as that of an original signal. When IFFT processing is executed after such substitution to obtain a privacy signal, random coefficient substitution in a high-frequency range does not contribute to a privacy strength due to degradation of hearing resolution. Therefore, if a wiretapper wiretaps the resultant privacy signal, he can easily infer an original speech signal.

As described above, in a conventional speech privacy processing apparatus using FFT, since FFT has the same resolution in a high-frequency range unlike the sense of hearing of a person, a large number of redundant (invalid) substitution patterns are generated, resulting in a degraded privacy effect.

SUMMARY OF THE INVENTION

It is an object of the present invention to provide a speech privacy processing method and an apparatus therefore, which can eliminate the conventional drawbacks, and can prevent generation of invalid substitution patterns in terms of a privacy effect in a frequency range of scrambler processing.

In a speech privacy processing method of the present invention for performing privacy processing of discrete signals obtained by sampling an input speech signal on the basis of Fourier transformation and scrambling processing, a transmitter side repetitively performs scrambling processing until the number of coefficients commonly included in a set of coefficients obtained by Fourier transformation and corresponding to high-frequency spectrum components of an input original speech signal and the set of coefficients corresponding to the high-frequency spectrum components after scrambling processing becomes smaller than a predetermined threshold value, and transmits the repetition count of the scrambling processing to a receiver side, and the receiver side performs inverse transformation processing to the privacy processing at the transmitter side in accordance with the repetition count of the scrambling processing executed at the transmitter side.

The upper limit of the repetition count of the scrambling processing is preferably set.

A speech privacy processing apparatus of the present invention for performing privacy processing of discrete signals obtained by sampling an input speech signal on the basis of Fourier transformation and scrambling processing, comprises means for obtaining the number of coefficients commonly included in a set of coefficients obtained by Fourier transformation and corresponding to high-frequency spectrum components of an input original speech signal and the set of coefficients corresponding to the high-frequency spectrum components after scrambling processing, scrambling means for repetitively performing scrambling processing until the number of the common coefficients becomes smaller than a predetermined threshold value, and scrambling count transmission means for counting the number of repetitions of the scrambling processing and transmitting the count to a receiver side.

The scrambling means preferably has an upper limit of the repetition count of the scrambling processing.

A privacy-processed speech reproduction apparatus of the present invention for reproducing a speech signal from a received privacy-processed signal on the basis of Fourier transformation and scrambling processing, comprises count extraction means for extracting a repetition count of scrambling processing from the reception signal, and speech reproduction means for reproducing a speech signal in accordance with the extracted repetition count.

DESCRIPTION OF THE PREFERRED EMBODIMENTS

An embodiment of the present invention will be described hereinafter with reference to the accompanying drawings.

Figure 1A:
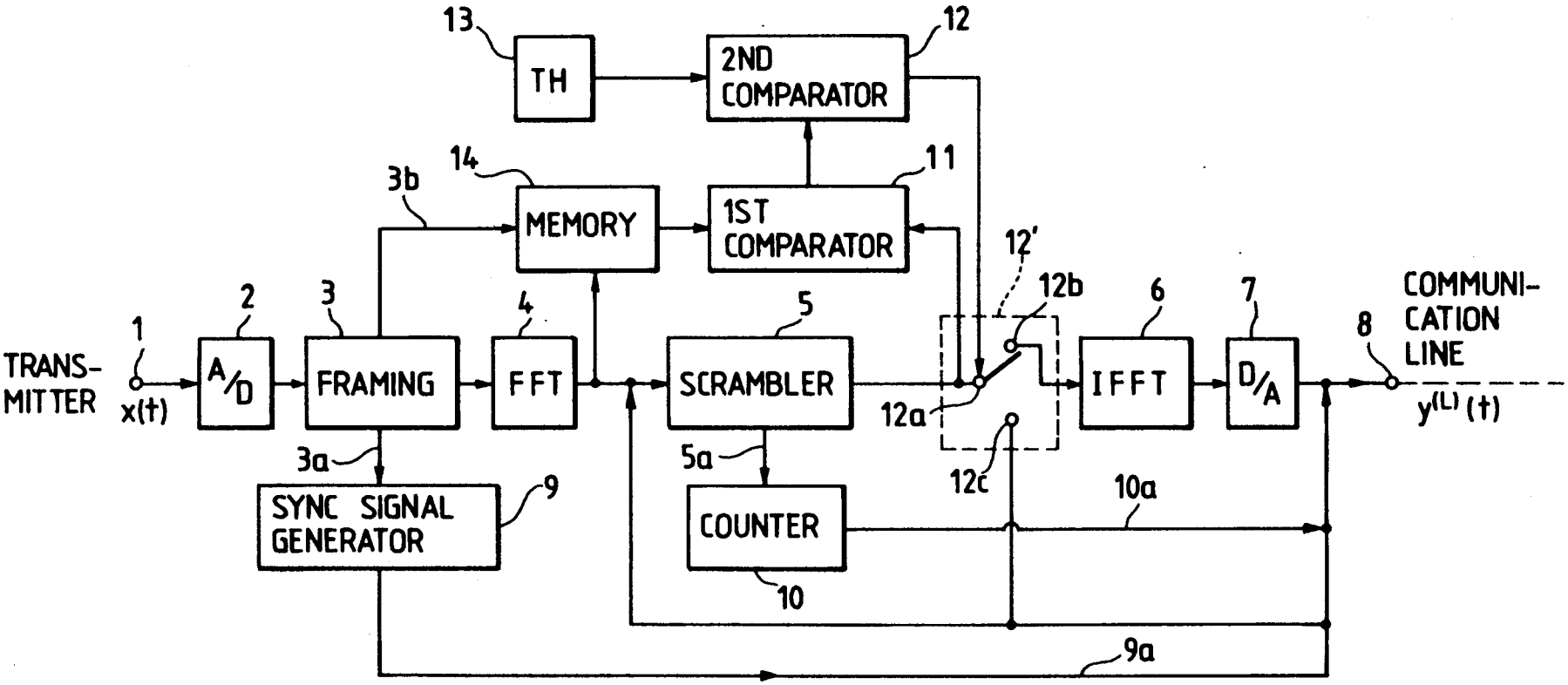
FIGS. 1A and 1B are block diagrams of a speech privacy processing apparatus and a privacy-processed speech reproduction apparatus according to an embodiment of the present invention.
Figure 1B:
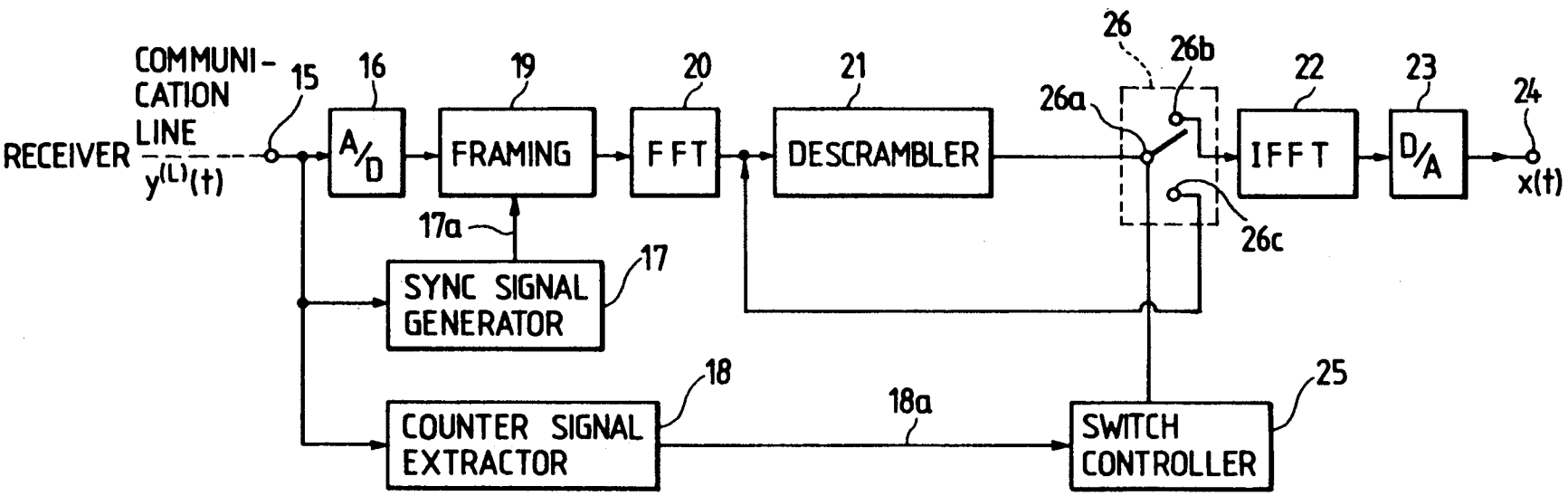
Figure 2A:
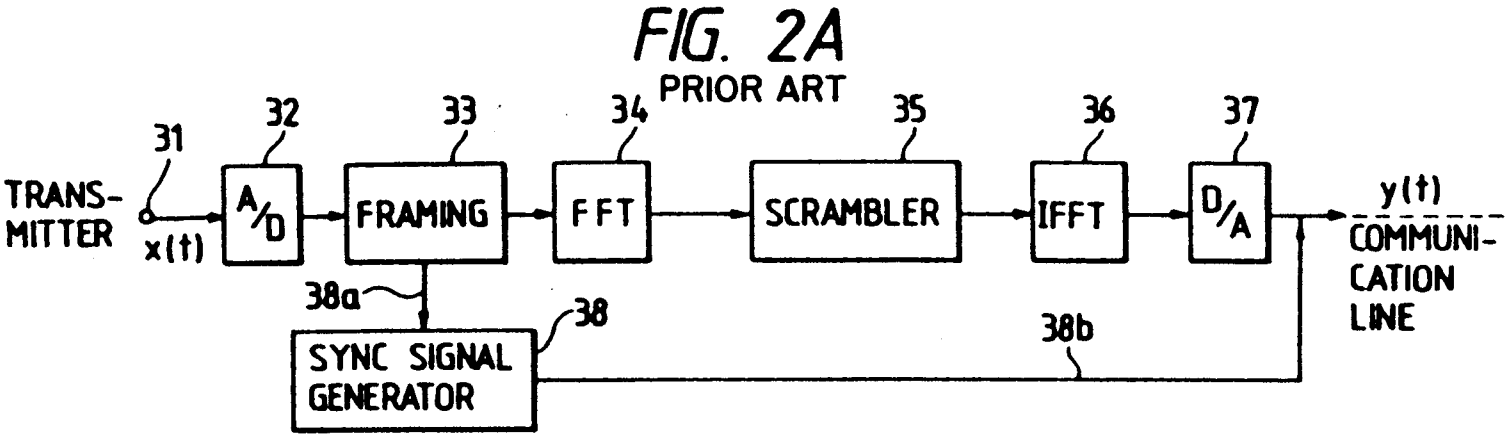
FIG. 2A PRIOR ART
FIGS. 2A and 2B are block diagrams of a speech privacy processing apparatus and a privacy-processed speech reproduction apparatus of a conventional FFT scrambler method.
Figure 2B:
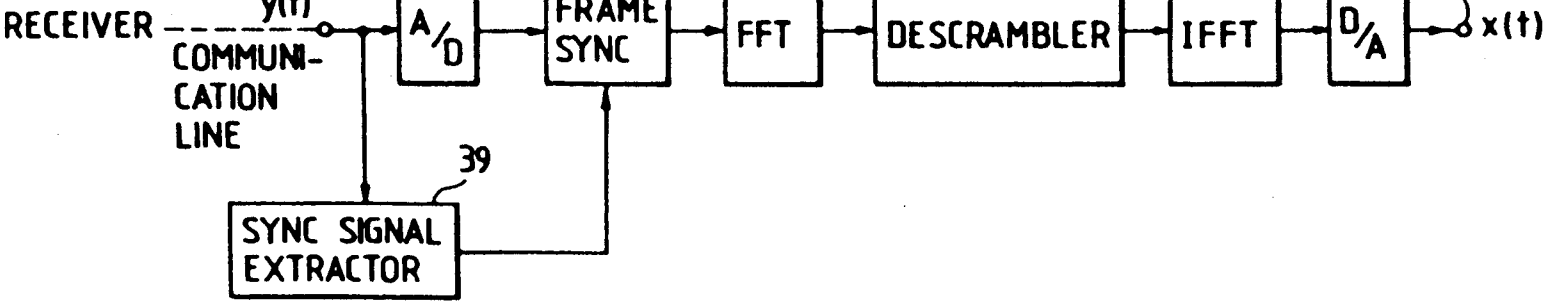
FIG. 2B PRIOR ART
Figure 3B:
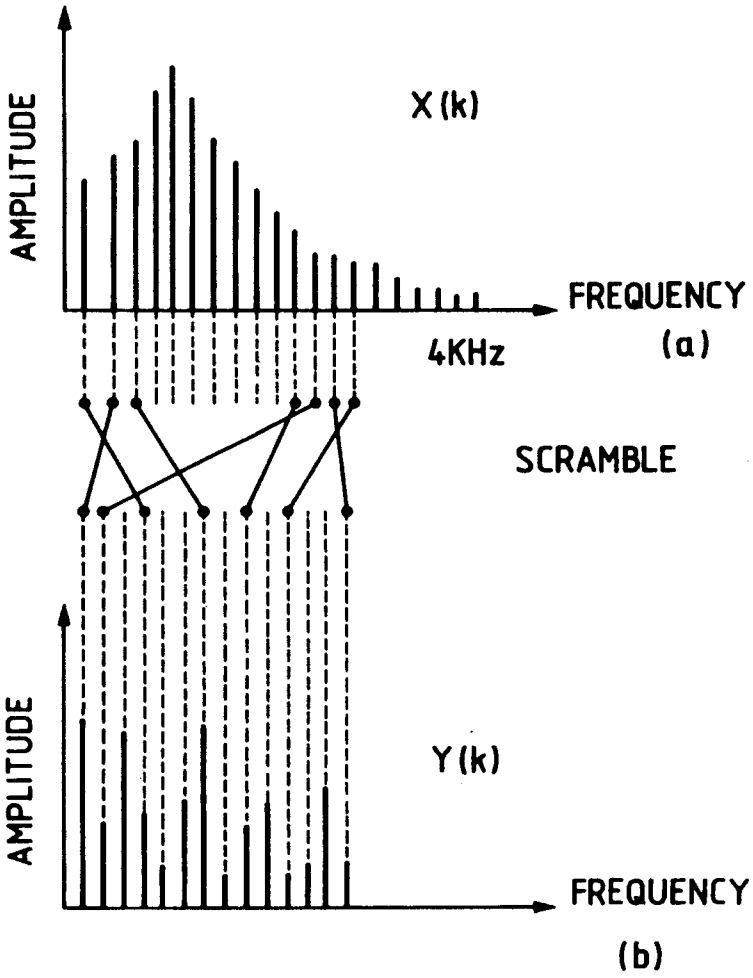
FIGS. 3A to 3C are views showing the principle of privacy processing by the FFT scrambler method.
Figure 3A:
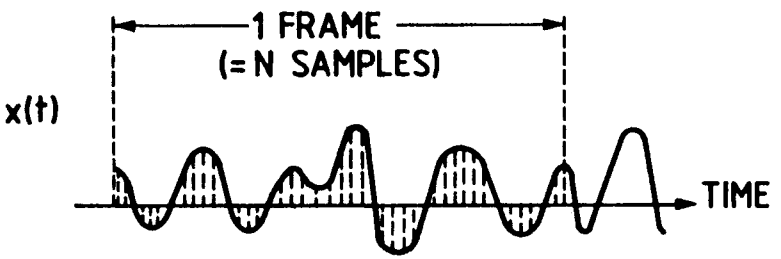
Figure 3C:
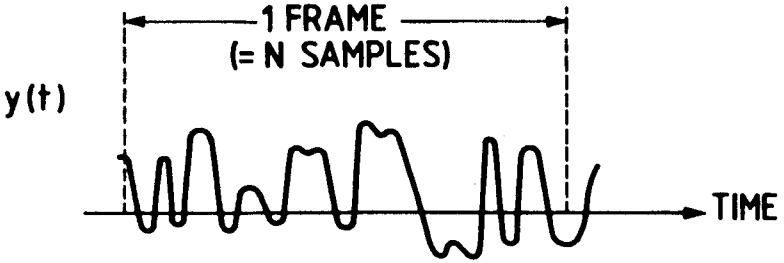
Figure 4:
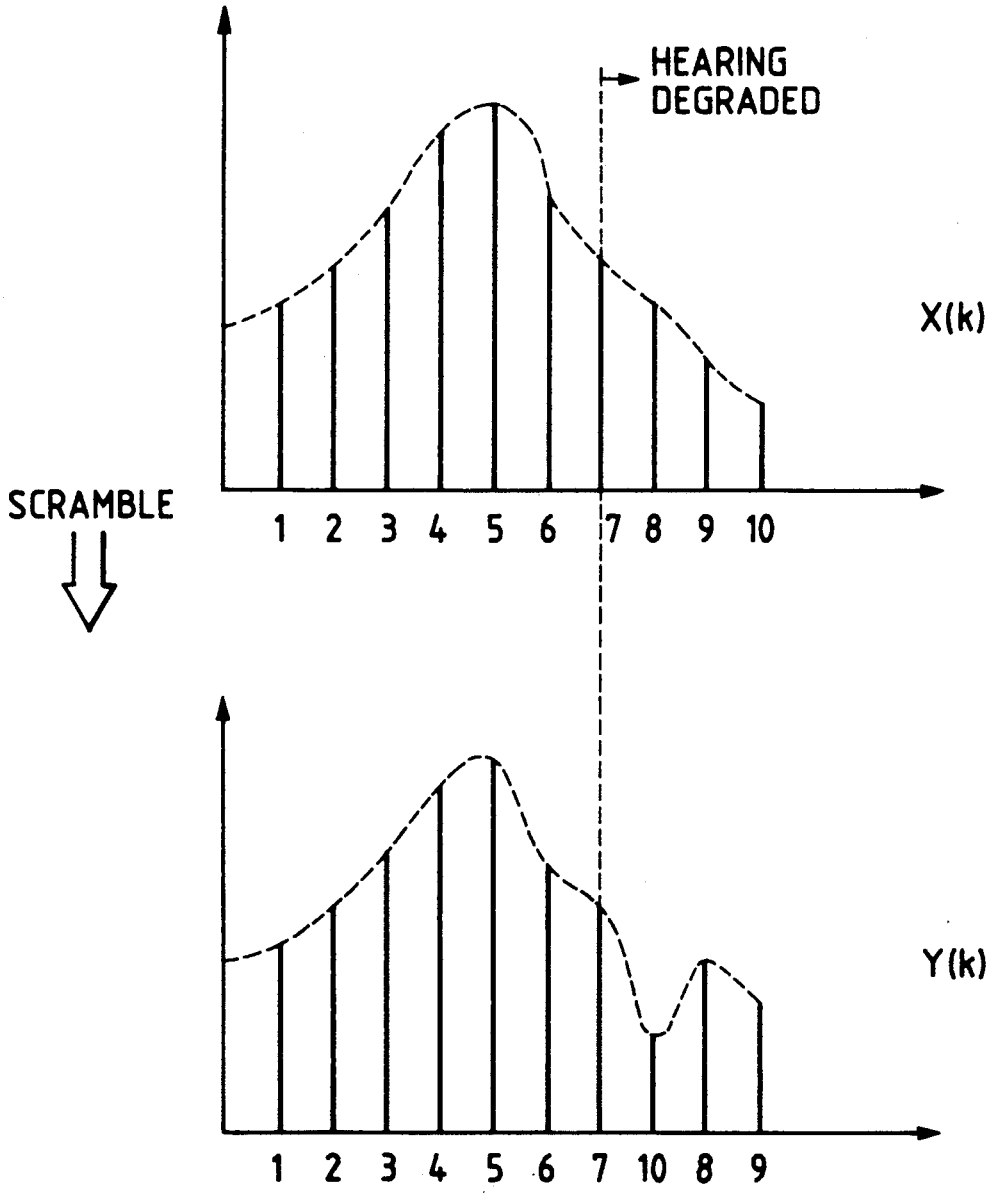
FIG. 4 is a view for explaining that a privacy signal with a low privacy effect is generated by the conventional FFT scrambler method.

FIGS. 1A and 1B are block diagrams of a speech privacy processing apparatus of this embodiment. In FIG. 1A, an input analog speech signal x(t) is input from an input terminal 1 to an A/D converter 2 and is converted into discrete signals x(n) (n=0, 1, 2, . . . ). The discrete signals are framed in units of N sample values (=one frame) by a framing circuit 3. Frame sync data 3*a* indicating the beginning of each frame is sent to a sync signal generator 9. In response to this signal, the sync signal generator 9 generates a frame sync signal 9*a*.

The discrete signals x(n) (n=0, 1, . . . , N−1) framed in units of N samples by the framing circuit 3 are input to an N-point fast Fourier transformation (FFT) unit 4, and are subjected to FFT calculations, thus obtaining N FFT coefficients X(k) (k=0, 1, . . . , N−1). The coefficients X(k) correspond to low- to high-frequency spectrum components of the input original speech signal x(t) serially from X(0) to X(N−1). Of these coefficients, FFT coefficients X(N−1), X(N−2), . . . , X(N−λ+1) corresponding to λ predetermined high-frequency spectrums are stored in a memory 14.

On the other hand, the N FFT coefficients X(k) (k=0, 1, . . . , N−1) are input to a scrambler 5, and are subjected to random substitution processing to be rearranged on a frequency axis. The rearranged coefficients are represented by $Y^{(1)}(k)$ (k=0, 1, . . . , N−1). In this case, a count-up signal 5*a* is supplied from the scrambler 5 to a counter 10. The counter 10 counts the number of times of scrambler processing for one frame. Of the scrambler outputs $Y^{(1)}(k)$ (k=0, 1, . . . , N−1), a set of λ FFT coefficients $\{Y^{(1)}(N-1), Y^{(1)}(N-2), \ldots, Y^{(1)}(N-\ +1)\}$ corresponding to λ high-frequency spectrum components are sent to a first comparator 11, and are compared with a set of λ FFT coefficients $\{X(N-1), X(N-2), \ldots, X(N-\lambda+1)\}$ stored in the memory. As a result, the comparator outputs the number $J^{(1)}$ of FFT coefficients commonly included in both sets to a second comparator 12.

The calculation operations of the first comparator 11 include $\lambda^2$ subtractions and an operation for counting the number of times that the subtraction result becomes "0". The second comparator 12 compares a threshold value m (positive integer) prestored in a threshold value supply circuit 13 with the output $J^{(1)}$ from the first comparator 11. When $J^{(1)}<m$, the comparator 12 connects a contact 12a of a switch 12, to a contact 12b; when $J^{(1)} \geqq m$, it connects the contact 12a of the switch 12, to a contact 12c.

Assume that $J^{(1)} \geqq m$ for the sake of descriptive convenience. $Y^{(1)}(k)$ $(k=0, 1, \ldots, N-1)$ are input to the scrambler 5 through the contact 12c of the switch 12', and are subjected to random substitution processing again, resulting in scrambler outputs $Y^{(2)}(k)$ $(k=0, 1, \ldots, N-1)$. In the same manner as in the above operations, the number $J^{(2)}$ of elements commonly included in a set of λ $\{X(N-1), X(N-2), \ldots, X(N-\lambda+1)\}$ and a set of λ $\{Y^{(2)}(N-1), Y^{(2)}(N-2), \ldots, Y^{(2)}(N-\lambda+1)\}$ is supplied from the first comparator 11 to the second comparator 12, and is compared with the threshold value m. Whether the contact 12a of the switch 12' is connected to the contact 12b or 12c is determined according to the comparison result.

Assuming that $J^{(L)}<m$ is satisfied for the first time after the Lth scrambler processing, the scrambler outputs $Y^{(L)}(k)$ $(k=0, 1, \ldots, N-1)$ are input to a fast inverse Fourier transformation (IFFT) unit 6 through the contact 12b of the switch 12', thus outputting $y^{(L)}(n)$ $(n=0, 1, \ldots, N-1)$.

$$y^{(L)}(n) = \frac{1}{N} \sum_{k=0}^{N-1} Y^{(L)}(k) e^{-(2\pi nk/N)j}$$

$(n=0, 1, \ldots, N-1)$

The N discrete signals are converted into an analog signal by a D/A converter 7, thereby obtaining a privacy signal $y^{(L)}(t)$ corresponding to one frame. When the signal $y^{(L)}(t)$ is output onto a transmission path, a count value (=L) signal 10a of the counter 10 and the frame sync signal 9a are added and superimposed on the privacy signal, and the superimposed signal is output from an output terminal 8. The memory 14 is cleared by a clear signal 3b which is generated when the next frame is formed by the framing circuit 3.

At a receiver side, a sync signal extractor 17 and a counter signal extractor 18 respectively extract the frame sync signal and the counter signal added at the transmitter side from the privacy signal $y^{(L)}(t)$ received from the transmission path, and supply the extracted signals to a framing circuit 19 and a switch controller 25. The received privacy signal $y^{(L)}(t)$ is converted into discrete signals by an A/D converter 16. The discrete signals are reproduced into a frame on the basis of a frame sync signal 17a in synchronism with the transmitter side by the framing circuit 19. The reproduced frame $y^{(L)}(n)$ $(n=0, 1, \ldots, N-1)$ is subjected to FFT calculations by an FFT unit 20, thus obtaining N outputs $Y^{(L)}(k)$ $(k=0, 1, \ldots, N-1)$.

The switch controller 25 controls a switch 26 in accordance with a count signal 18a reproduced from the received signal, and connects a contact 26a of the switch 26 to a contact 26c until descrambling processing having an inverse relationship with the scrambling processing executed at the transmitter side is executed L times for the received frame. A descrambler 21 executes descrambling processing of $Y^{(L)}(k)$ $(k=0, 1, \ldots, N-1)$, and outputs $X(k)$ $(k=0, 1, \ldots, N-1)$. The switch controller 25 connects the contact 26a of the switch 26 to a contact 26b, and the descrambler outputs $X(k)$ $(k=0, 1, \ldots, N-1)$ are subjected to IFFT processing by an IFFT unit 22 to be converted to $x(n)$ $(n=0, 1, \ldots, N-1)$. The N discrete signals are converted into an analog signal by a D/A converter 23, and the analog signal is output from an output terminal 24. As a result, the input original speech signal $x(t)$ is descrambled.

In the privacy processing section of the transmitter side in the above embodiment, if the number $J^{(L)}$ of common elements to be compared with the threshold value m after the Lth processing operation satisfies $J^{(L)} \geqq m$, (L+1)th, (L+2)th, ... scrambling processing operations are successively executed. However, in consideration of a processing delay time caused by the scrambler and the descrambler, an upper limit of the comparison count L is preferably determined. More specifically, if $J^{(M)} \geqq m$ after the scrambler repeats processing M times, the scrambler outputs $Y^{(M)}(k)$ $(k=0, 1, \ldots, N-1)$ may be forcibly output to the IFFT unit 6 to obtain a privacy signal.

In this embodiment, the processing counts of the scrambler and the descrambler are controlled by the switches 12 and 26. The apparatus may comprise a microprocessor which operates according to a program, and the processing counts may be controlled in a software manner.

As described above, according to this embodiment, invalid scrambling operations and substitution patterns are omitted in a high-frequency range where the hearing resolution of a person is degraded, and only valid substitution patterns are employed. Therefore, a privacy signal having a higher privacy strength than that of a conventional speech privacy processing apparatus can be obtained.

What is claimed is:

1. A speech privacy processing apparatus comprising:

scrambling means for scrambling an input original speech signal;

obtaining means for obtaining a number of elements included in common among high-frequency components of the original speech signal and high-frequency components of the scrambled signal;

control means for controlling said scrambling means to repeat its scrambling operation until said number of elements becomes smaller than a predetermined threshold; and count means for counting the number of repetitions of the scrambling operation.

2. An apparatus according to claim 1, wherein said control means controls said scrambling means to repeat its scrambling operation not more than a predetermined maximum number of times.

3. A speech privacy processing method comprising the steps of:

scrambling an input original speech signal;

judging whether the scrambling step is being performed including frequency components other than high-frequency components of the original speech signal and of the scrambled signal; and repeating the scrambling operation until the judging step judges that the scrambling operation is being performed including the frequency components other than high-frequency components.

4. A method according to claim 3, wherein the scrambling step is repeated not more than a predetermined maximum number of times.

5. A speech privacy processing apparatus comprising:

means for scrambling an input original speech signal;

means for counting a number of scrambling operations performed by said scrambling means; and means for transmitting data representing the number counted by said counting means.

6. A speech privacy processing method comprising the steps of:

scrambling an input speech signal repeatedly;

counting the number of the repeated scrambling operations; and transmitting the counted number together with the scrambled signal.

7. A speech privacy processing method for processing a received signal which was scrambled a number of times and which includes the number of scrambling operation, comprising the steps of:

extracting the number of scrambling operations from the revived signal;

descrambling the revived signal a number of times, which number is equal to the extracted number; and reproducing an original speech from the descrambled received signal.

8. A speech privacy processing apparatus for processing a received signal which was scrambled a number of times and which includes the number of scrambling operations, comprising:

means for extracting the number of scrambling operations from the received signal;

means for descrambling the received signal a number of times, which number is equal to the extracted number; and means for reproducing an original speech from the descrambled received signal.

* * * * *

UNITED STATES PATENT AND TRADEMARK OFFICE

CERTIFICATE OF CORRECTION

PATENT NO. : 5,018,198

DATED : May 21, 1991

INVENTOR(S) : FUTOSHI TAKAHASHI

It is certified that error appears in the above-identified patent and that said Letters Patent is hereby corrected as shown below:

COLUMN 1

Line 54, "$x(n)=\lambda A(\lambda)\cos(\alpha\cdot\lambda n)+\theta(\lambda))$" should read --$x(n)=\ell A(\ell)\cos(\alpha\cdot\ell n)+\theta(\ell))$--.

Signed and Sealed this

Twenty-ninth Day of December, 1992

*Attest:*

DOUGLAS B. COMER

*Attesting Officer*

*Acting Commissioner of Patents and Trademarks*